United States Patent [19]

Heyting

[11] Patent Number: 4,757,912

[45] Date of Patent: Jul. 19, 1988

[54] METHOD OF MAKING A FILLED CONTAINER AND PRODUCT

[75] Inventor: Hendrik G. Heyting, Epse, Netherlands

[73] Assignee: Thomassen & Drijver - Verblifa, Netherlands

[21] Appl. No.: 739,021

[22] Filed: May 29, 1985

[30] Foreign Application Priority Data

Jun. 8, 1984 [NL] Netherlands ..... 8401835

[51] Int. Cl.[4] ..... B65B 3/00; B65B 7/28; B65B 31/00

[52] U.S. Cl. ..... 220/316; 220/66; 53/425; 53/440; 53/471; 53/473; 53/486; 53/487

[58] Field of Search ..... 53/486, 487, 467, 471, 53/289, 290, 440, 473, 425; 220/66, 316

[56] References Cited

U.S. PATENT DOCUMENTS

| | | | |
|---|---|---|---|
| 2,124,959 | 7/1938 | Vogel | 53/471 |
| 2,185,191 | 1/1940 | Gray et al. | 53/440 X |
| 3,103,089 | 9/1963 | Allen | 53/289 X |
| 3,117,873 | 1/1964 | Bartels et al. | 53/432 X |
| 3,342,009 | 9/1967 | Anderson | 53/486 X |
| 3,492,773 | 2/1970 | Bergstrom | 53/453 X |
| 3,517,475 | 6/1970 | Balocca | 53/432 |
| 3,517,476 | 6/1970 | Bowen | 53/471 |
| 3,590,557 | 7/1971 | Vogel | 53/289 X |
| 3,674,060 | 7/1972 | Ruekberg | 53/289 X |
| 3,889,443 | 6/1975 | Wingardh | 53/471 X |
| 4,228,633 | 10/1980 | Corbic | 53/471 X |
| 4,338,765 | 7/1982 | Ohmori et al. | 53/289 X |
| 4,458,469 | 7/1984 | Dunn | 53/478 X |
| 4,667,454 | 5/1987 | McHenry et al. | 53/425 |

*Primary Examiner*—Horace M. Culver
*Attorney, Agent, or Firm*—John P. Snyder

[57] ABSTRACT

A tubular body provided with a first end wall is filled through the open end thereof and sealed by a second end wall. One of these walls has a hole therethrough closed by a closing means, this wall being initially of generally concave configuration with the closing means disposed entirely inwardly of a plane passing through the rim of the wall. The concave wall is subsequently changed to a generally convex configuration with the closing means disposed at least partially outwardly of the plane.

19 Claims, 4 Drawing Sheets

METHOD OF MAKING A FILLED CONTAINER AND PRODUCT

Figure 1:
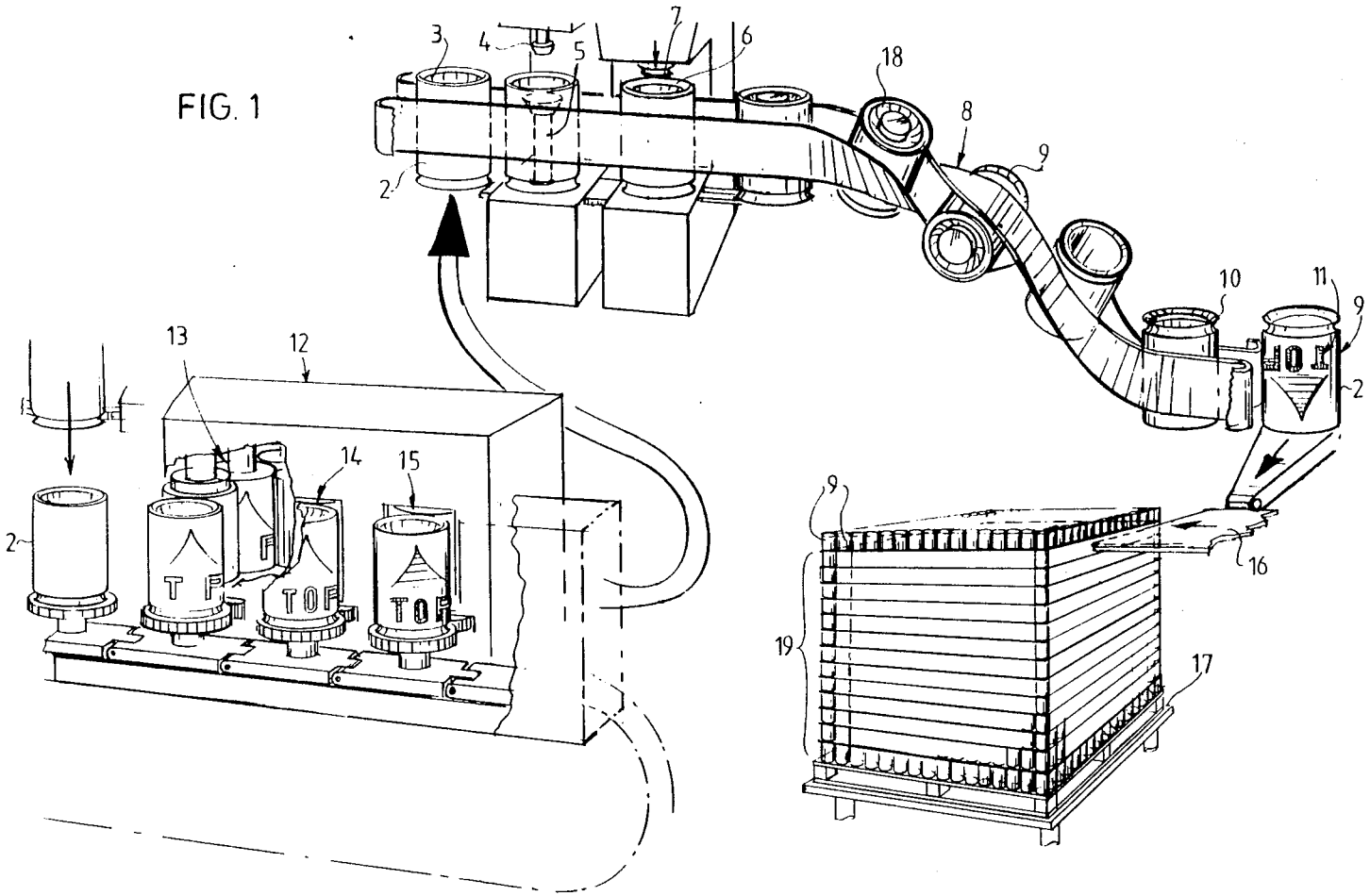

The invention relates to a method of manufacturing a container filled for example, with a beverage or a mixture with driving gas, having a body and two end walls, at least one of which is provided with a closing element for a pouring opening, the container being filled and subsequently closed.

In the manufacture of a container containing a beverage, in particular an aerated beverage there is an increasing need for more freedom in selecting the type of closing element and in selecting the material of the closing element, the end walls and the body. An important requirement is that independently of the choice the container concerned should be workable as far as possible without adaptation of the existing filling apparatus.

When an "easy opening" closing element is chosen the metal of the end wall with the pouring opening and of the closing element is usually aluminium, whilst the remaining part of the container is made from sheet iron. Owing to the presence of aluminium such containers cannot be recycled or at high costs only. If instead of aluminium sheet iron is chosen for the end wall with the pouring opening and the corresponding closing element, complex, constructions have to be used for hermetically closing the pouring opening.

If the closing element is made from a synthetic resin, the problem is involved that at least part of the synthetic-resin closing element extends as far as beyond a plane going through the circumferential edge of the head end of the container concerned so that the extension interferes with various parts of the apparatus by which the container is made and filled with the beverage so that such a closing element of synthetic resin is not or only hardly usable. Is such a small closing element of synthetic resin is made that it does not project beyond the plane going through the circumferential rim of the head of the container, difficulties arise, for example, in putting the pouring opening to the mouth for taking in the container's contents.

The invention has for its object to improve the method of the kind set forth in the preamble in a sense such that the largest possible freedom is obtained in choosing the type of closing element as well as of the material of the closing element, the end walls and the body, whilst the above-mentioned disadvantages are avoided as far as possible. According to the invention this is achieved in that a container is used in which the closing element is arranged in an end wall which, when the container is closed, has a substantially concave shape, whilst after the container is closed the end wall is caused to go over to a convex shape.

The substantially concave shape is a form in which the concave surface slopes upwards to a circumferential rim, whereas in the case of a convex form the convex surface slopes down towards the circumferential rim.

Since, when the container is being made, the closing element is located in the space mainly determined by the concave shape in accordance with the invention such a container embodying the invention, when being filled with a beverage, cannot be distinguished from a conventional container so that all manipulations, for example, transport and filling in filling apparatus can be carried out by the existing systems. Since the closing element is arranged in advance, the hermetic seal of the closing element relative to the end wall can be checked before the container is filled.

If the end wall having a substantially concave shape is a separate end wall, it constitutes the cover. Despite the presence of the closing element such covers are readily stackable.

If the end wall having a substantially concave shape is a monolith with the body, the bodies provided with such end walls can also be satisfactorily stacked.

After the container is closed, the container should preferably be put upside down so that the transition from the concave shape to the convex shape can take place undisturbed. Since the container is already filled with a beverage, the assembly has such a mass that the transition from the concave to the convex shape hardly produces any motion in the container and during said transition such containers will not fall over.

If such a closing element is used that the closing element and/or the end wall with the pouring opening are suitable for a recycling process of the container, such containers have greater value after being emptied, because they can be recycled in a simple manner. If the closing element is preferably made from a synthetic resin and the end wall is made from the same type of material in a concave shape as the body, the synthetic resin will decompose and disappear when the recycling process is a fusing process.

A particularly environmental-friendly container is obtained when the closing element is connected with the container so that it cannot be lost.

The method embodying the invention can be carried out on any existing system when the container with a closing element in accordance with the invention has the same, external cylindrical shape as the existing tins. This is ensured when such a closing element is used that in a direction away from the substantially concave surface of the end wall a part of the closing element projecting from said surface is located in a space bounded by the substantially concave surface and a plane going through a circumferential rim of a head end of said end wall.

The transition from a concave shape to a convex shape can take place in a very simple manner in the existing methods of manufacturing a container to be filled, when by pasteurisation or by the developing gas from the beverage the end wall is caused to change over from a substantially concave to a convex shape.

A further aspect of the invention relates to a method of manufacturing a container intended to be filled with a beverage or with a propelling gas for a spray said container having a body and two end walls, at least one of which is provided with a closing element for a pouring opening, said closing element being arranged on the end wall.

The semi-product made for use in the above described method embodying the invention has, in particular, to be such that filling and closing of the container, usually at a different place, can be carried out by means of the existing systems. Moreover prior to the delivery of the semi-product all possible checks of the hermetic seal between the closing element and the pouring opening have to be possible. According to the invention this is ensured when the closing element is arranged in an end wall of substantially concave shape.

The invention furthermore relates to an apparatus for manufacturing a container to be filled with a beverage or a spray, said apparatus comprising a unit for closing the container filled with the beverage, said apparatus being characterized in accordance with the invention by an apparatus following the closing unit for turning the closed container upside down.

Finally the invention relates to the manufactured container, container part and/or an end wall apparently intended for use in the method of manufacturing a container to be filled with a beverage or a spray.

The above-mentioned and further features will be described more fully with reference to a number of non-limitative embodiments of the methods and apparatus in accordance with the invention and with reference to the accompanying drawing.

The drawing shows in

Figure 2:
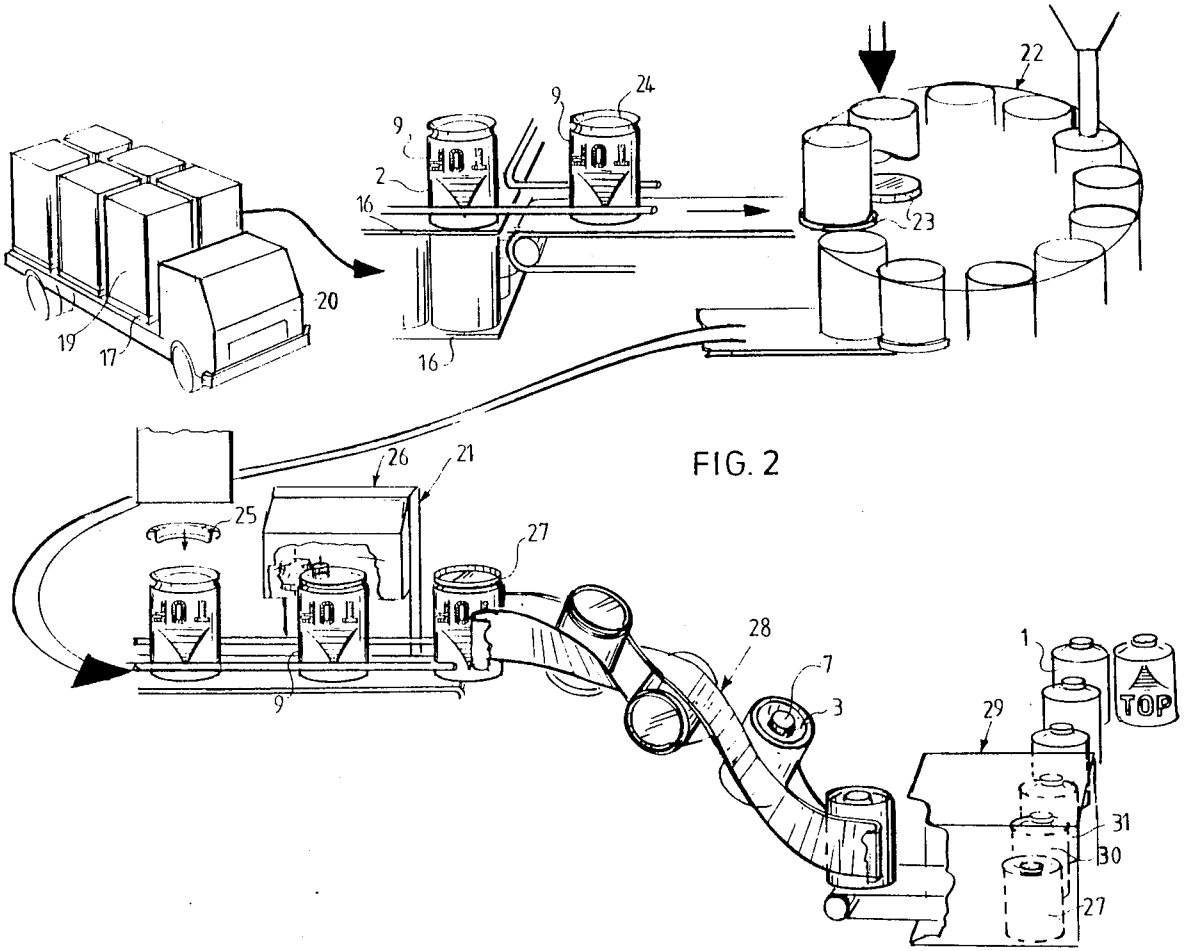
Figure 3:
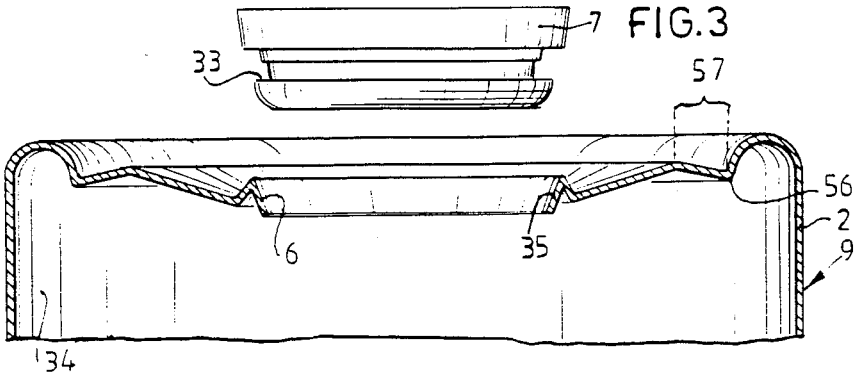
Figure 4:
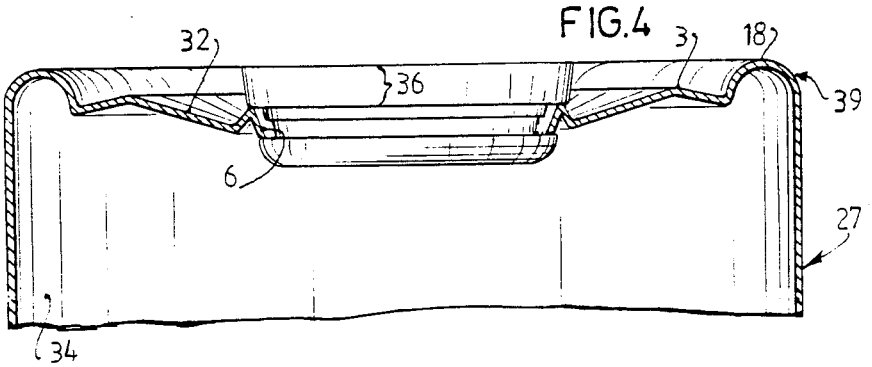
Figure 5:
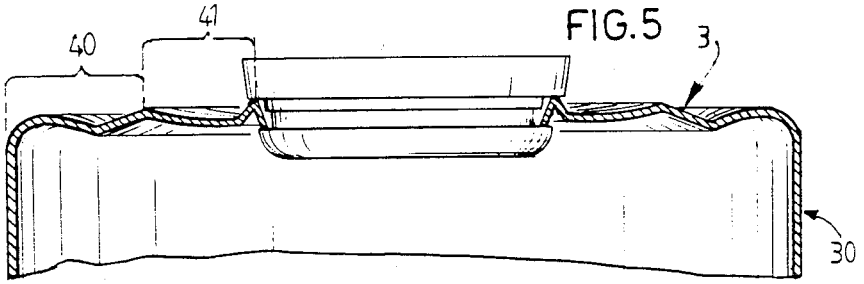
Figure 6:
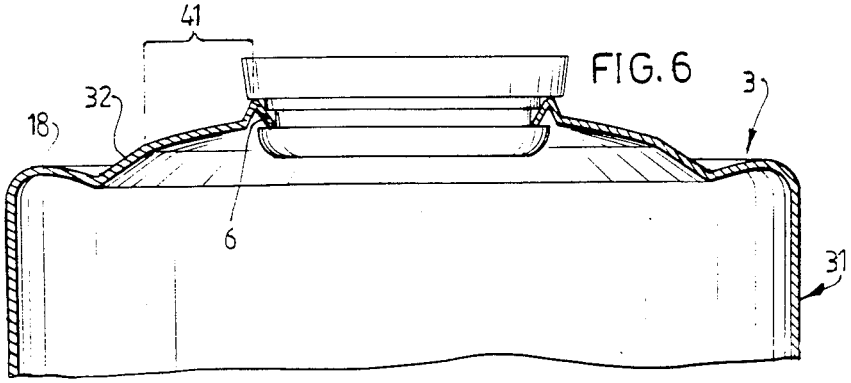
Figure 7:
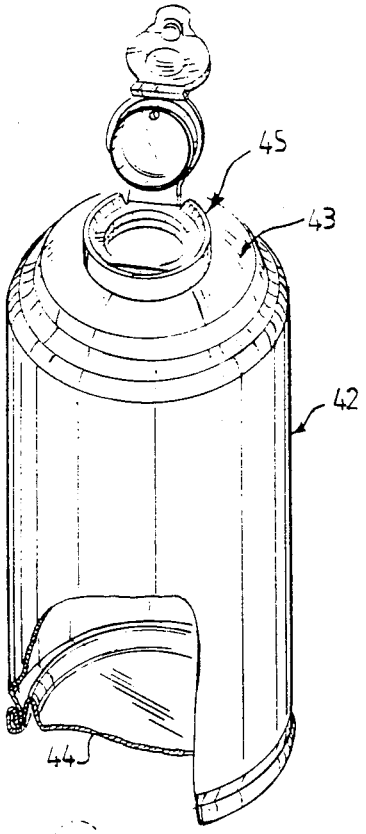
Figure 8:
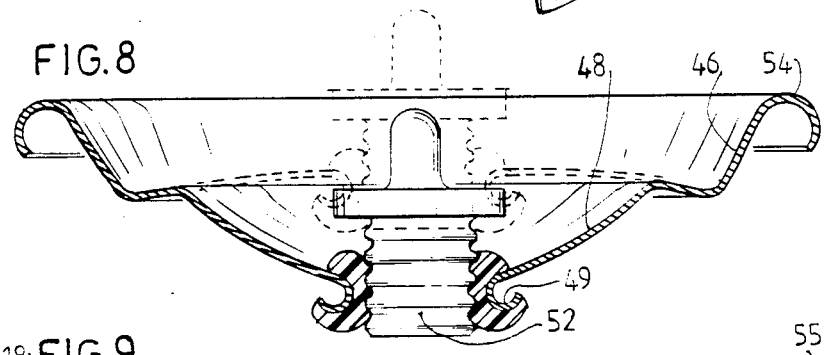
Figure 9:
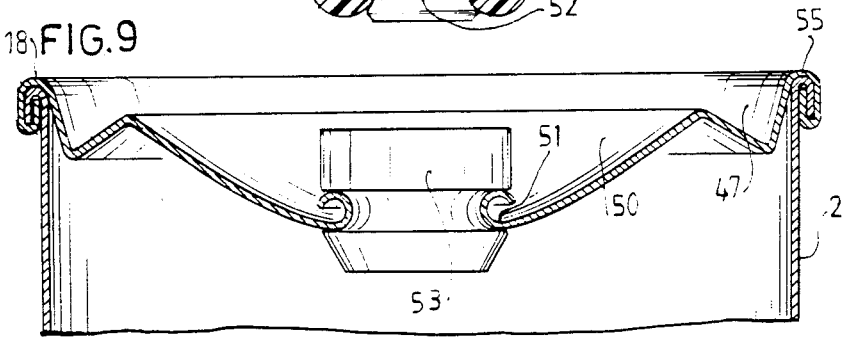

FIG. 1 schematically a method embodying the invention for manufacturing a container to be filled with a beverage, FIG. 2 schematically a method of filling a container with a beverage manufactured by the method illustrated in FIG. 1, FIG. 3 an enlarged sectional view of an end wall with a pouring opening having a substantially concave shape, in which the closing element is arranged, FIGS. 4, 5 and 6 the transition from the substantially concave shape to the substantially convex shape after the container is filled, FIG. 7 a fragmentary, perspective view of a further embodiment of a container manufactured in accordance with the invention and FIGS. 8 and 9 each a sectional view like FIG. 4 of other embodiments of an end wall provided with a closing element and having a substantially concave shape.

FIG. 1 illustrates a method embodying the invention for the manufacture of a container 1. In this embodiment the starting material is a deep-drawn, thin body 2 having an end wall 3 monolithically connected with it. It will be obvious that a welded body with a flanged end wall may also be used.

With the aid of the co-operating punching elements 4 and 5 an opening 6 is made in the end wall 3, in which opening a closing element 7 is subsequently fastened, as the case may be, by gluing. Then with the aid of the inverting apparatus 8 the container part 9 is turned upside down so that the container part 9 is directed upwards by the open end 10.

It will be apparent that a decoration 11 applied to the body 2 is oriented relatively to the end wall 3 of the concave shape forming a monolith with the body 2.

Prior to punching the opening 6 the decoration is applied to the body 2 in a decoration apparatus 12 comprising printing units 13, 14 and 15 operating with three different colours.

The ready container parts 9 are received on a separation skin 16 and then stacked on a pallet 17.

The container parts 9 can be captured in a conventional manner on the separation skin 16 because the closing element is completely located inside a plane going through the circumferential rim of a head end 39 of the end wall 3 (see FIG. 4).

FIG. 2 illustrates the method of manufacturing a container containing a beverage, in which the starting material is a container part 9 made by the method illustrated in FIG. 1. A stack 19 of container parts 9 standing on a pallet 17 is supplied by a vehicle 20.

The container parts 9 are assembled directly from the separation skin 16 in an existing device 21 for filling with a beverage and subsequently closing the container. Filling is performed by means of a caroussel 22 comprising disc-shaped tables 23 having a continuous carrying surface so that it is avoided that, for example when the container is being filled, the end wall of the substantially concave shape changes over to an end wall having a substantially convex shape. An important advantage involved in filling the container part 9 is that the container part has an open end 24, the diameter d of which is equal to the maximum diameter of the body 2 so that the container part 9 can be filled with the beverage within a short time. Then a second end wall 25 is placed on the head end 24 and rigidly secured in a flanging unit 26 to the container part 9. When leaving the flanging unit 26 the container 27 is hermetically closed. The hermetically closed container 27 is then turned upside down in an inverting apparatus 28 so that the end wall 3 provided with the closing element 7 is again directed upwards prior to entering for example, a pasteurisation apparatus 29.

In the pasteurisation apparatus the hermetically closed containers 27 filled with a beverage are subjected to a thermal treatment so that the pressure in the containers 27 increases. This pressure is built up to cause the shape of the end wall with the closing element 7 to change over from the substantially concave shape to the convex shape. This change-over is shown in further detail in FIGS. 4, 5 and 6.

FIG. 4 shows a detail of the container 27 directly after entering the pasteurisation apparatus 29. For the sake of clarity the contents of the container 27 are not shown. FIG. 4 clearly shows that the end wall 3 forming in this case a monolith with the body 2 and having a substantially concave shape has a surface 32 ascending radially outwards from the pouring opening 6 towards the circumferential rim 18. The closing element 7 having an annular groove 33 and held in the opening 6 has a rim 35 inclined towards the interior of the container 27 and snapping into said groove 33. The closing element 7 has a shape such that a part 36 of the closing element 7 projecting from the surface 32, viewed in a direction away from the surface 32 of the end wall 3, is located within a space 37 bounded by the subtantially concave surface 32 and a plane 38 going through the circumferential rim 18 of the head end 39 of the end wall 3.

During the passage through the pasteurisation apparatus 29 (see FIG. 5) the concave shape of the end wall 3 disappears since an annular part 40 of the end wall 3 is bulged outwards, whereas the further radially inner part 41 of the end wall 3 substantially maintains its original shape. In the position shown in FIG. 5 the closing element 7 has got outside the plane 38. Towards the termination of the pasteurisation (see FIG. 6) the pressure has reached such a value that also the part 41 of the end wall 3 bulges outwards so that the end wall 3 has assumed a substantially convex shape, which means that from the opening 6 the surface 32 descends towards the circumferential rim 18. Apart from the improved accessibility of the pouring opening 6 in putting the opening 6 directly at the mouth, an important advantage of the change-over to the convex shape is that the volume of the container has increased. This increased volume may be used as the expansion volume for the beverage contained in the container 1 during pasteurisation, which means that for filling the same amount of beverage a smaller container can be used, which saves material.

It will be obvious that the transition from the concave shape to the convex shape of the end wall 3 can be ensured not only by subjecting the closed container to pasteurisation. The pressure increase resulting from the aeration of the beverage contained in the container to be closed may also be used for the change-over from the concave shape to the convex shape.

FIG. 7 shows a different embodiment of a container 42 in accordance with the invention in which the convex shape of the end wall 43 has again been formed after the container 42 has been filled with a beverage and closed by the end wall 44. The end wall 43 is provided with a closing element 45 of known type, which is rigidly connected with the end wall 43.

FIGS. 8 and 9 both show a variant of an end wall 46, 47 both constructed as separate elements to be folded onto a body 2. The end wall 46 has a bead 49 facing away from the concave surface 48, whereas the end wall 47 has a bead 51 facing the concave surface 50. When the end walls 46 and 47 have both a concave shape, the closing elements 52 and 53 are both located inside a plane going through the circumferential rim 54 of the end wall 56 and, respectively, the circumferential rim 55 of the end wall 47.

It should be noted that the construction of the end wall is such that after the change-over of the end wall into the convex shape it is no longer possible under normal conditions for the end wall to return to the concave shape. This is mainly ensured by the annular groove 56 which is directly adjacent the circumferential rim 18 and has a radially inwardly and upwardly inclined part 57.

The use of a synthetic-resin closing element has interesting advantages because in this case the body and the two end walls can be made from the same material, for example, sheet iron so that in recycling the sheet iron the synthetic resin is burnt and disappears during fusion. Therefore, such containers consisting of a single type of material still have a comparatively high residual value after the contents have been consumed.

Since the end wall changes over to the convex shape, the thickness of the end wall may be smaller than the thickness of an original hollow bottom, since a hollow bottom has to be thicker in order to maintain the hollow shape after filling and closing the container despite the increased pressure in the container.

Although not described in detail it will be obvious that the centered opening shown 6 may, in principle, be made, eccentrically so as to extend up to the part 57 of the end wall 3, which appreciably improves direct consumption of the contents by the mouth.

Although the invention is explained only for a container containing a beverage, it will be obvious that any type of container may be used provided the contents are capable of matching the increase in volume resulting from the transition from the concave to the convex shape of the end wall having a closing element. The transition of the shape may be ensured by building up an internal pressure or by external means (for example, in vacuo).

A further type of container having contents at excess pressure is a spray can.

I claim:

1. The method of making a filled container which comprises the steps of providing a container having an open end and an opposite end provided with an end wall of generally concave shape having an opening therein, closing the opening in said end wall, filling the container through the open end thereof with filling material while maintaining said end wall in generally concave shape, sealing the open end of the container to confine the filling material therein, and then causing said end wall to change from a generally concave shape to a generally convex shape.

2. The method as defined in claim 1 wherein the shape of said one wall is changed by increasing the internal pressure within the container.

3. The method as defined in claim 2 wherein the internal pressure within the container is increased by heating the contents of the container.

4. The method as defined in claim 2 wherein the container is filled with a carbonated beverage, the internal pressure within the container being increased by aeration of the beverage.

5. The method as defined in claim 1 wherein subsequent to closing the opening in said end wall and prior to filling the container, said opposite end of the container is placed on a supporting surface with said open end of the container facing upwardly, and subsequent to sealing the filled container, the container is turned upside down.

6. The method as defined in claim 1 wherein said end wall is initially formed as a separate wall and is then sealed to said container.

7. The method as defined in claim 1 wherein said end wall is formed integral with said container.

8. A filled container manufactured according to the method as defined in claim 1.

9. The method of making a filled container which comprises the steps of forming a tubular container having an open end and an opposite end closed by a first end wall which is of generally concave configuration and which has a circumferential rim and a pouring hole therein, closing said pouring hole with a closing means and maintaining the closing means in such a position that the closing means is disposed entirely inwardly towards the center of the container with respect to a plane passing through said circumferential rim, filling the container with filling material through the open end of said container while maintaining said first end wall in generally concave configuration and said closing means in said position, sealing the open end of the container with a second end wall to seal the filling material within the container, and then causing said first end wall to be changed from a generally concave configuration to a generally convex configuration and moving said closing means at least partially outwardly of said plane.

10. The method as defined in claim 9 wherein the configuration of said first end wall is changed by increasing the internal pressure within the container.

11. The method as defined in claim 10 wherein the internal pressure with the container is increased by heating the contents of the container.

12. The method as defined in claim 10 wherein the container is filled with a carbonated beverage, the internal pressure within the container being increased by aeration of the beverage.

13. The method as defined in claim 9 wherein subsequent to closing said pouring hole and prior to filling the container, said opposite end of the container is placed on a supporting surface with said open end of the container facing upwardly, and subsequent to sealing the filled container, the container is turned upside down.

14. The method as defined in claim 9 wherein said first end wall is initially formed as a separate wall and and is then sealed to said container.

15. The method as defined in claim 9 wherein said first end wall is formed intergral with said container.

16. The method as defined in claim 9 wherein a decoration is applied to the outer surface of the container prior to filling the container.

17. The method as defined in claim 9 wherein said first end wall is made of the same material as said container, and said closing means is made of synthetic resin.

18. The method as defined in claim 9 wherein said closing means is formed integral with said first end wall.

19. The method as defined in claim 9 wherein said closing means is inserted in said pouring hole and sealed with respect thereto to close said pouring hole.

* * * * *